US007448325B2

(12) United States Patent
Harrison

(10) Patent No.: US 7,448,325 B2
(45) Date of Patent: Nov. 11, 2008

(54) PROJECTILE

(75) Inventor: Leslie Mervyn Harrison, Hocking (AU)

(73) Assignee: Techventure Investments Pty. Ltd. (AU)

( * ) Notice: Subject to any disclaimer, the term of this patent is extended or adjusted under 35 U.S.C. 154(b) by 129 days.

(21) Appl. No.: 10/557,321

(22) PCT Filed: Mar. 31, 2005

(86) PCT No.: PCT/AU2005/000473

§ 371 (c)(1),
(2), (4) Date: Nov. 18, 2005

(87) PCT Pub. No.: WO2005/095884

PCT Pub. Date: Oct. 13, 2005

(65) Prior Publication Data

US 2006/0230971 A1 Oct. 19, 2006

(30) Foreign Application Priority Data

Apr. 2, 2004 (AU) ..... 2004901771
Sep. 6, 2004 (AU) ..... 2004905053

(51) Int. Cl.
*F42B 14/02* (2006.01)
*F42B 15/00* (2006.01)

(52) U.S. Cl. ..... 102/524; 102/380; 102/501; 102/526

(58) Field of Classification Search ..... 102/374, 102/375, 376, 431, 439, 490, 501, 517, 524, 102/526, 529, 380, 527
See application file for complete search history.

(56) References Cited

U.S. PATENT DOCUMENTS 816,577 A * 4/1906 Haase ..... 102/517
1,191,357 A 7/1916 Synder
2,307,369 A * 1/1943 Ferrel ..... 102/380
2,408,252 A 9/1946 Ganahl
2,424,934 A * 7/1947 Kasper ..... 102/380

(Continued)

FOREIGN PATENT DOCUMENTS

AU 2579/21 3/1922

(Continued)

OTHER PUBLICATIONS

Photo—caseless cartridge developed for the Heckler & Koch G 11.
International Search Report PCT/AU2005/000473.
International—Type Search Report AU National Application No. 2004901771.

*Primary Examiner*—James S Bergin
(74) *Attorney, Agent, or Firm*—Portland Intellectual Property, LLC

(57) ABSTRACT

A projectile (10) comprises a cylindrical body (12) with a first (leading) end (14) and a second trailing axially opposed end (16). An internal cavity (18) is formed between the ends (14 and 16) and holds a volume of propellant material (22). The first end (14) is closed by a nose (20) that is fixed to the body (12). The end (14) is sealed with a base seal (26) that seats a primer (24) for igniting the propellant (22). The primer (24) is located inboard of the second end (16) and the base seal (26) to reduce the likelihood of accidental activation. Seals (30) are formed about the body (12) for maintaining gas pressure of deflagrating propellant. The seals (30) may be formed integrally with the body (12) or separately from the body (12) and seated in respective grooves (40) formed circumferentially about the body (12). Also disclosed is a breech sleeve (810) shaped to complement the breech of the weapon and a throughway (816) defined by an internal surface, the projectile being able to pass through the throughway (816).

19 Claims, 9 Drawing Sheets

U.S. PATENT DOCUMENTS

| | | | | | |
|---|---|---|---|---|---|
| 2,928,348 | A | | 3/1960 | Zisman et al. | |
| 3,169,483 | A | | 2/1965 | Gawlick | |
| 3,398,684 | A | * | 8/1968 | Kvavle | 102/374 |
| 3,754,507 | A | * | 8/1973 | Dillinger et al. | 102/374 |
| 3,815,503 | A | | 6/1974 | Infantino | |
| 3,999,486 | A | * | 12/1976 | Bower | 102/526 |
| 4,326,463 | A | | 4/1982 | Burke et al. | |
| 4,404,765 | A | | 9/1983 | Reudelsterz et al. | |
| 4,610,205 | A | * | 9/1986 | Bentley | 102/529 |
| 5,148,620 | A | | 9/1992 | Nelson | |
| 5,221,809 | A | | 6/1993 | Cuadros | |
| 5,363,769 | A | | 11/1994 | Bellak et al. | |
| 5,682,011 | A | | 10/1997 | Sabranski et al. | |
| 6,234,058 | B1 | | 5/2001 | Morgado | |
| 6,581,522 | B1 | | 6/2003 | Julien et al. | |

FOREIGN PATENT DOCUMENTS

| | | |
|---|---|---|
| CH | 678889 | 11/1999 |
| DE | 2838208 | 7/1982 |
| DE | 8433256.5 | 11/1984 |
| DE | 2852173 | 4/1993 |
| GB | 725821 | 9/1955 |
| GB | 2251290 | 7/1992 |
| GB | 2336197 | 10/1999 |
| GB | 2336654 | 10/1999 |
| WO | 2002033343 | 4/2002 |

* cited by examiner

PROJECTILE

FIELD OF THE INVENTION

The present invention is for a projectile for firing from a weapon, and in particular, but not exclusively, to a projectile for firing from a firearm.

BACKGROUND OF THE INVENTION

A common firearm ball type ammunition as opposed to shotgun ammunition comprises a metallic cartridge case containing a volume of propellant, with a primer fixed at one end of the case and a bullet or projectile releasably attached at the other end of the case. The performance of this type of ammunition is restricted by reason of the propellant being ignited at a point furthest from the bullet. The propellant, when ignited, deflagrates producing high volumes of gas. When the pressure of the gas has built to a sufficient level, it causes separation of the bullet from the cartridge case and propels the bullet along a barrel of an associated firearm. At this time, any remaining unburnt propellant is also expelled from the case into the barrel where its deflagration efficiency is greatly reduced due to the decrease in pressure because of the greater volume to which it is exposed. As a consequence, the potential propulsive force applied by the deflagrating propellant is also reduced. Moreover, a point is reached where regardless of the addition of further propellant to the case, very little gain in bullet velocity is achieved as a substantial proportion of the additional propellant is likely to burn outside of the barrel of the firearm on exit of the bullet and thus provide no useful thrust or velocity to the bullet.

A further problem with a conventional round is the extraction and ejection of the spent case after firing, particularly in automatic weapons. Such weapons require an extraction and ejection system to eject the spent cartridge. Indeed failure of the extraction and ejection mechanism is one of the main causes of automatic weapon stoppages and other malfunctions.

Throughout this specification, except where the context requires otherwise due to express language or necessary implication, the word "comprise" or variations such as "comprises" or comprising is used in an inclusive sense, i.e. to specify the presence of the stated features but not to preclude the presence or addition of further features in various embodiments of the invention.

SUMMARY OF THE INVENTION

According to one aspect of the present invention there is provided a projectile for firing out of a barrel of a weapon, the barrel having an inner diameter, the projectile comprising:

a substantially cylindrical body with first and second axially opposite ends and a cavity defined between the first end and the second end for holding a quantity of first propellant, the first end being closed by a nose fixed to the body, the cylindrical body having a first outer diameter which is less than the inner diameter of the barrel and one or more grooves extending circumferentially about an outer circumferential surface of the body, respective seals seated in the one or more grooves, each seal formed separately of the body and protruding radially from the body to form a substantial seal against an inner circumferential surface of the barrel, each respective seal having a second outer diameter greater than or equal to the inner diameter.

According to a second aspect of the present invention there is provided a projectile for firing out of a barrel of a weapon, the barrel being made of a barrel material and having an inner diameter, the projectile comprising:

a substantially cylindrical body with first and second axially opposite ends and a cavity defined between the first end and the second end for holding a quantity of propellant, the first end being closed by a nose fixed to the body, the cylindrical body having a first outer diameter which is less than the inner diameter of the barrel, the cylindrical body being made of a first material; and at least one seal extending about an outer circumferential surface of the body, each seal protruding radially from the body to form a substantial seal against an inner circumferential surface of the barrel and having a second outer diameter greater than the first outer diameter and equal to or greater than the inner diameter of the barrel, the at least one seal being made of a second material, wherein the second material is softer than the barrel material, and the first material is harder than the second material.

In one embodiment, each groove comprises a first portion and a second portion, the first portion being forward of the second portion in a direction of firing of the projectile, and wherein the first portion is of a greater death than the second portion.

The first portion may have a width equal to a width of the respective seal.

The second portion can be shaped to receive a deformed portion of the respective seal. In this embodiment, the second portion can have a depth equal to the width of the respective seal. Alternatively or additionally, the second portion can have a width greater than a difference between the second outer diameter and the first outer diameter.

In one embodiment, in which there is provided a first seal adjacent the first end and a second seal adjacent the second end, the outer diameter of the first and second seal is at least equal to the inner diameter of a breech that opens into the barrel of the weapon, such that the second end of the projectile can be supported in the breech.

In one embodiment, the first material comprises steel. In one alternative embodiment, the first material comprises brass.

In an embodiment, the second material comprises copper.

The at least one of the seals can be formed separately from the body. Preferably, each seal is in the form of a ring.

According to a third embodiment, there is provided a projectile for firing out of a barrel of a weapon, the barrel having an inner diameter, the projectile comprising:

a substantially cylindrical body with first and second axially opposite ends and a cavity defined between the first end and the second end for holding a quantity of propellant, the first end being closed by a nose fixed to the body, the cylindrical body having a first outer diameter less than the inner diameter of the barrel; and, at least two sets of a plurality of closely spaced seals extending about an outer circumferential surface of the body, each seal protruding radially from the body to form a substantial seal against an inner circumferential surface of the barrel having a second outer diameter greater than the first outer diameter and equal to or greater than the inner diameter of the barrel, wherein a first set of seals is disposed near the first end and a second set of seals is disposed near the second end.

Preferably, each seal is deformed as the seal contacts the inner circumferential surface of the barrel.

According to a fourth embodiment of the present invention, there is provided a projectile for firing out of a barrel of a weapon, the barrel having an inner diameter, the projectile comprising:

a substantially cylindrical body with first and second axially opposite ends and a cavity defined between the first end and the second end for holding a quantity of propellant, the first end being closed, the cylindrical body having a first outer diameter less than the inner diameter of the barrel;

at least one seal extending about an outer circumferential surface of the body, each seal protruding radially from the body to form a substantial seal against an inner circumferential surface of the barrel and having a second outer diameter greater than both the first outer diameter and the inner diameter of the barrel, the at least one seal being made of a second material; and a mass attached to the body and extending over the first end.

In one embodiment, the mass comprises a skirt that surrounds a portion of the body adjacent the first end. The skirt may comprise an inner circumferential surface provided with one or more members protruding radially inwards and the body comprises one or more seats for receiving the one or more members thereby attaching the mass to the body.

In an alternative embodiment, the skirt comprises one member and the body comprises one seat where the member is a circumferential lip and the seat is a groove which receives the lip. The skirt can extend radially of the body to form a substantial seal between the between the body and an inner circumferential surface of the barrel of the weapon from which the projectile is fired.

According to a fifth aspect of the present invention, there is provided a projectile for firing out of a barrel of a weapon, the barrel having an inner diameter, the projectile comprising;

a substantially cylindrical body with first and second axially opposite ends and a cavity defined between the first end and the second end for holding a quantity of propellant, the first end being closed by a nose fixed to the body, the cylindrical body having a first outer diameter which is less than the inner diameter of the barrel; and, one or more seals extending about an outer circumferential surface of the body, each seal protruding radially from the body to form a substantial seal against an inner circumferential surface of the barrel and having a second outer diameter, wherein the one or more seals is provided with a lubrication means to lubricate the barrel as the projectile is fired through the barrel.

The lubrication means may comprise a coating of a lubricating material applied to each seal.

Alternatively, the lubrication means can comprise a lubricant contained within each seal such that as the projectile is fired through the barrel the seal is ruptured and the lubricant is released.

In one embodiment, each seal comprises a lubricating material.

In one further embodiment, the projectile can comprise a primer for igniting the propellant, the primer being supported by the cylindrical body and located inboard of the second end of the cylindrical body.

In yet another embodiment, the projectile can further comprise:

a base seal closing the second end of the cylindrical body, such that the primer is supported by the seal, wherein the base seal opens after ignition of the primer to allow gases produced during deflagration of the propellant to escape from the second end of the cylindrical body.

The base seal can be formed so that the base seal is ruptured by the gases produced during deflagration of the propellant, thereby opening the base seal.

Alternatively, the base seal can be formed so that it is consumed during deflagration of the propellant, thereby opening the base seal.

A flash hole may be provided in the base seal such that a flame generated by ignition of the primer can propagate through the flash hole to the propellant.

BRIEF DESCRIPTION OF THE DRAWINGS

In order that the invention may be more easily understood, embodiments of the present invention will now be described, by way of example only, with reference to the accompanying drawings in which.

DETAILED DESCRIPTION OF PREFERRED EMBODIMENTS

Figure 1:
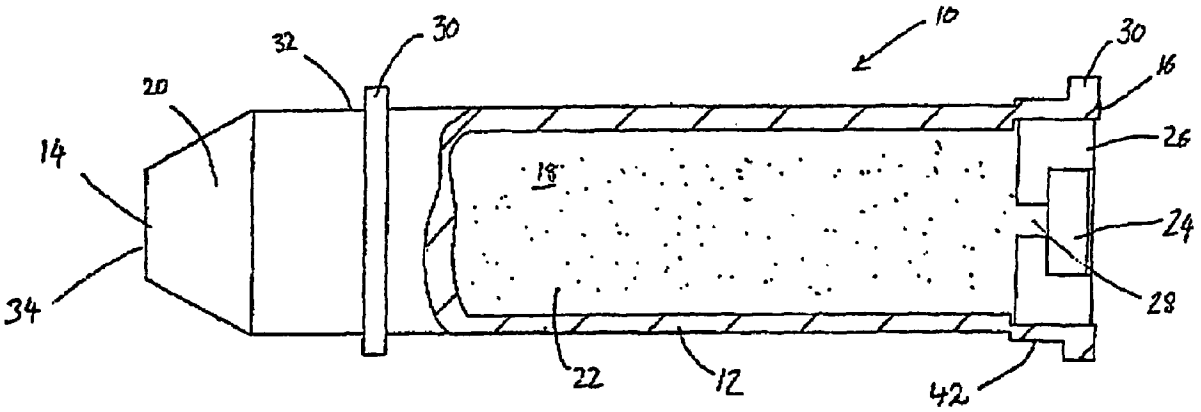
FIG. 1 is a partial section view of an embodiment of a projectile in accordance with the present invention.

FIG. 1 shows a projectile 10 according to an embodiment of the present invention. The projectile 10 comprises a substantially cylindrical body 12 having a first (leading) end 14 and a second (trailing) axially opposite end 16. An internal cavity 18 is defined between the first end 14 and the second end 16. The first end 14 is closed by a nose 20 having a flat face 34, the nose 20 being fixed to the body 12. Moreover, in this embodiment, the nose 20 is formed integrally with the body 12, however the nose can be formed separately of, but subsequently permanently fixed or attached to the body 12. Indeed the term "fixed" as used throughout this specification and claims, except where the context requires otherwise due to express language or necessary implication, is used to mean permanently attached to and may include such attachment as a result of being formed integrally with a proceeding component or part of an article. A quantity of propellant 22 is disposed within the cavity 18. A primer 24 for igniting the propellant 22 is also disposed in the cavity 18. More particularly, the primer 24 is held within a base seal 26 that is pressed into the body 12 at the second end 16. In order to reduce the likelihood of accidental activation primer 24 is advantageously located inboard of the second end 16 and the base seal 26.

The projectile 10 can be loaded into a conventional firearm such as a handgun, rifle or larger calibre military gun. Upon pulling the trigger of the firearm (not shown), a firing pin strikes the primer 24 causing it to ignite and eject a flame (not shown) through a flash hole 28 formed in the base seal 26. This causes the propellant 22 to deflagrate, producing large volumes of gas. The continued deflagration of the propellant increases the pressure of the gas within the body 12 until the gas pressure reaches a level where it bursts or ruptures the base seal 26, alternatively the propellant may burn through the seal 26 and/or primer 24. The gas pressure then acts between the projectile 10 and the internal surfaces of the firearm including the bore and breech, propelling the projectile 10 along the bore and subsequently into the surrounding atmosphere.

In contradistinction to conventional firearm rounds, comprising a cartridge case and a bullet, the propellant 22 in the projectile 10 may, depending on burning rate, remain within the body 12 even after the projectile 10 has left the bore of the firearm. The propellant 22 continues to deflagrate until it is completely consumed. Accordingly all of the propellant now contributes to the thrust and velocity of the projective 10. Significantly, this contribution to projectile thrust is made without attendant frictional drag against the bore or barrel of the firearm.

It should be further appreciated that the projectile 10 will generally have a substantially greater mass than a bullet of a conventional round of similar dimension (i.e. length and calibre). This rises due to the projectile 10 comprising the mass of the entire body 12 whereas in the conventional round, the mass of the cartridge is not added to the mass of the bullet as the cartridge case is not expelled with the bullet. The energy of a moving body is proportional to its mass and the square of its velocity. Thus in the present instance, the projectile 10 will provide substantially greater transfer of energy on impact, and thus greater force, due to its increased mass and/or velocity in comparison with a conventional round of similar calibre and identical propellant composition and volume.

In order to minimise reduction of gas pressure once the base seal 26 has been ruptured, the projectile 10 is provided with one or more seals 30. The seals 30 extend about an outer circumferential surface 32 of the body 12 and protrude radially to form a substantial gas seal against an inner circumferential surface of the bore or barrel of the firearm from which the projectile 10 is fired. In the embodiment shown in FIG. 1, two seals 30 are provided. One seal 30 is adjacent the second end 16 while the second seal 30 is formed toward the first end 14 but inboard of the nose 20. In this embodiment, the seals 30 are formed integrally with the body 12.

Figure 2:
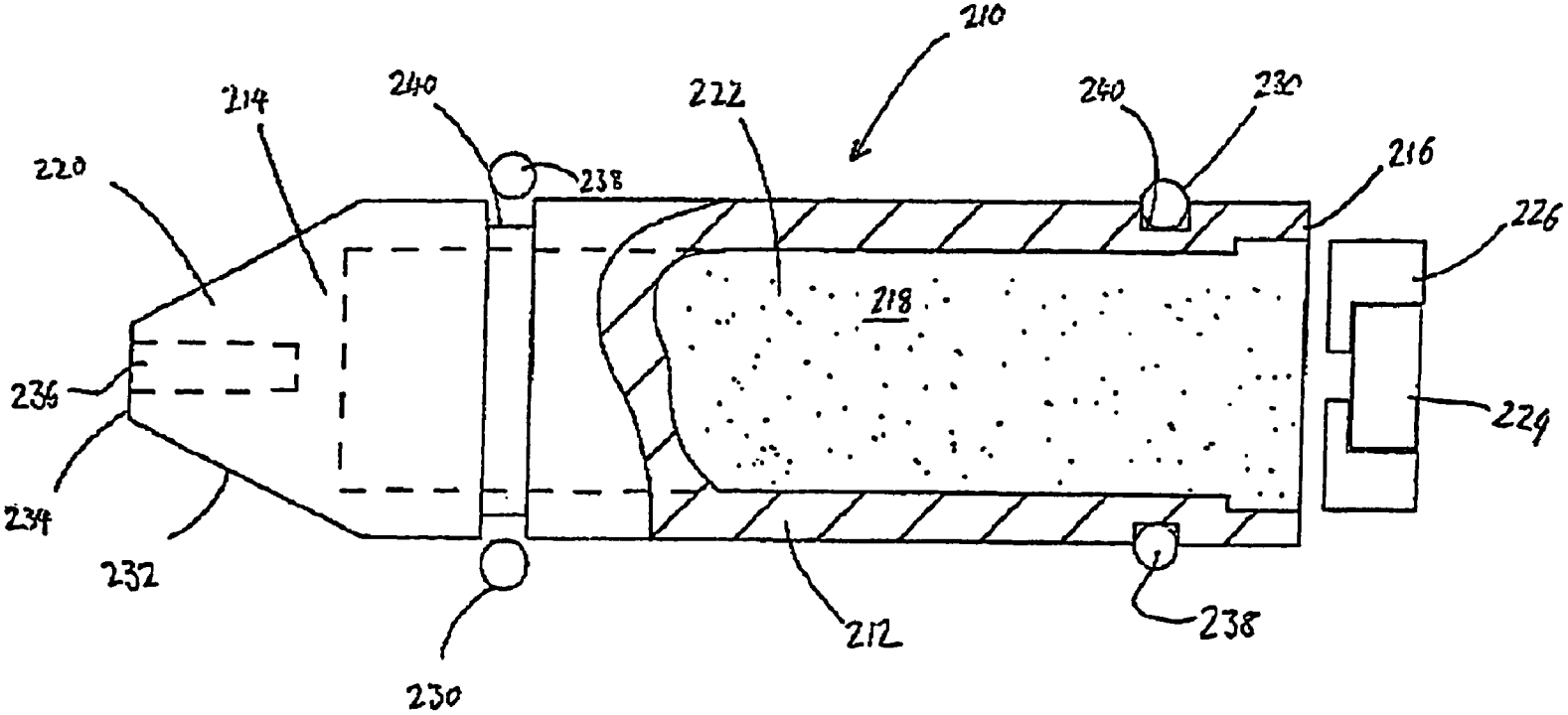
FIG. 2 is a partial section view and partial exploded view of a second embodiment of the projectile.

FIG. 2 shows a projectile 210 according to a second embodiment. The projectile 210 comprises a cylindrical body 212 with axially opposed first and second ends 214, 216 and a cavity 218 therebetween holding a volume of propellant 218. The first end 214 of the body 212 is closed by an integrally formed nose 220 with a flat leading face 234.

As with the projectile 10, the nose 220 of the projectile 210 comprises a portion 232 of frusto-conical shape reducing in diameter in a direction from the second end 216 to the first end 214. However projectile 210 differs from projectile 10 by the inclusion of a recess 236 (shown in broken lines) formed in the nose 220, the recess 236 opens onto the leading face 234. The recess 236 can be formed in any conventional manner including for example machining or casting. By virtue of the recess 236, the projectile 210 effectively acts as a "hollow tip" bullet.

The projectile 210 also differs from projectile 10 by the provision of seals 230 that comprise individual rings 238 that seat in respective circumferential grooves 240 formed about the outer circumference of the body 212. The rings 238 may be formed as an open loop of spring metal, similar to a conventional piston ring. When fully seated in its respective groove 240, each ring 238 sits proud of the outer circumference of the body 212 to provide a substantial seal against an inner circumferential surface of the bore or barrel of the firearm from which the projectile 210 is fired. This assists in preventing gases caused by the deflagration of the propellant 222 from flowing past the projectile 210 as it travels through the bore or barrel.

A further, though minor difference between the projectiles 10 and 210 is in the configuration of the body 12, 212 at the second end 16, 216. In the projectile 10 shown in FIG. 1, the outer circumference of the body 12 at the end 16 is provided with a first portion 42 having a stepped increase in outer diameter leading to the seal 30 adjacent the end 16.

Figure 3:
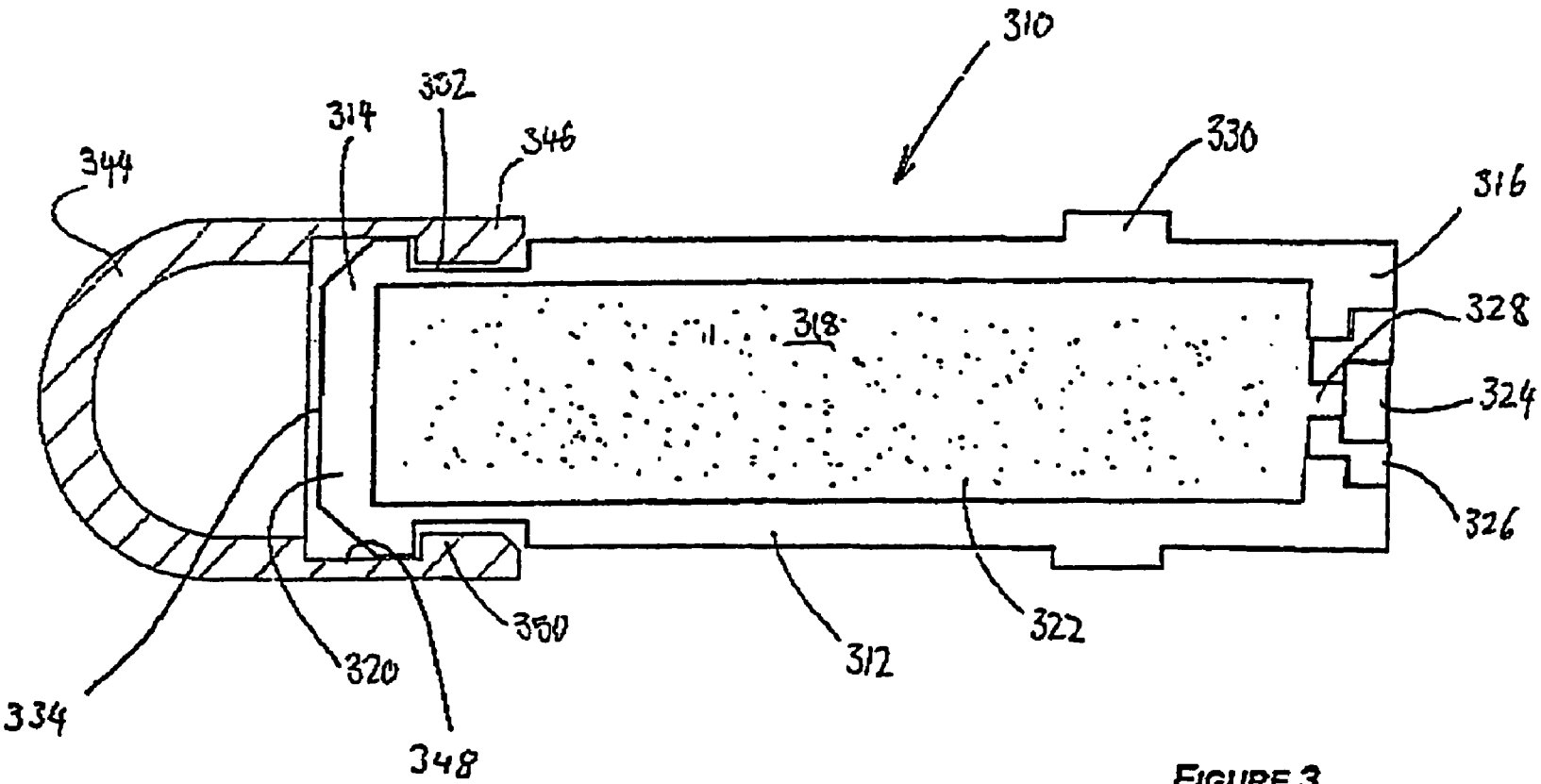
FIG. 3 is a section view of a third embodiment of the projectile.

FIG. 3 depicts yet a further embodiment of the projectile 310 having a similar basic form to the projectiles 10 and 210, and comprising a substantial cylindrical body 312 having a first end 314 that is closed by an integral nose 320 with the end 316 of the body 312 closed by a base seal 326 and primer 324; and a cavity 318 holding a volume of propellant 322. However, the nose 320 of projectile 310 has a leading face 334 of a diameter substantially equal to the end diameter of the body 312.

The projectile 310 also comprises an integrally formed seal 330 near, but inboard of the second end 316. In order to increase its stopping power, the projectile 310 is provided with an additional mass 344 which is attached to the body 312 at the first end 314. The mass 344 is substantially domed shaped and has a skirt 346 that surrounds the portion of the body 312 adjacent the nose 320. The skirt 346 comprises an inner circumferential surface 348 provided with a member in the form of a lip 350 that protrudes radially inwards and is received within a circumferential groove 352 formed in the body 312 inboard of the nose 320. The engagement of the lip 350 in the seat 352 effectively attached the mass 344 to the body 312. It will also be noted that the skirt 346 extends radially of the body 312. In use, the skirt 346 forms a substantial seal between the body 312 and the inner circumferential surface of a bore or barrel of a weapon or firearm from which the projectile 310 is fired.

The mass 344 is depicted in FIG. 3 as being hollow, however it can be solid, depending on the additional mass required, or may contain an impact sensitive explosive composition.

Figure 5:
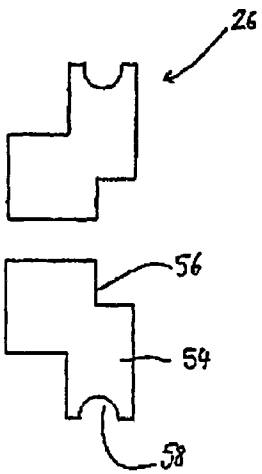
FIG. 5 is a section view of a second form of base seal that can be incorporated in the projectile shown in FIGS. 1-3.
Figure 4:
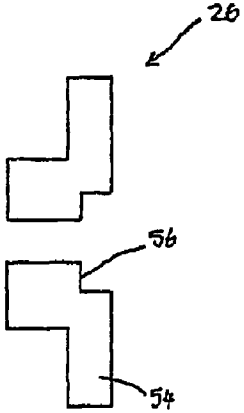
FIG. 4 is a section view of one form of a base seal that can be incorporated in the projectile shown in FIGS. 1-3.

FIGS. 4 and 5 depict alternate configurations of the base seal 26 to suit different types of firearms. In FIG. 4, the base seal 26 is rimmed, being provided with a laterally extending flange 54 to enable manipulation by a conventional extraction mechanism that extracts the cartridge/projectile from the breech. The base 26 is also provided with a primer recess 56 for seating a conventional primer 24.

In FIG. 5, the base 26 is configured as a conventional rimless base having a flange 54 of smaller diameter and with a concave circumferential recess 58.

Figure 6:
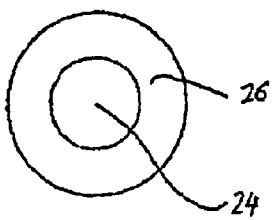
FIG. 6 is an end view of a base seal and primer incorporated in the projectile shown in FIGS. 1-3.
Figure 7:
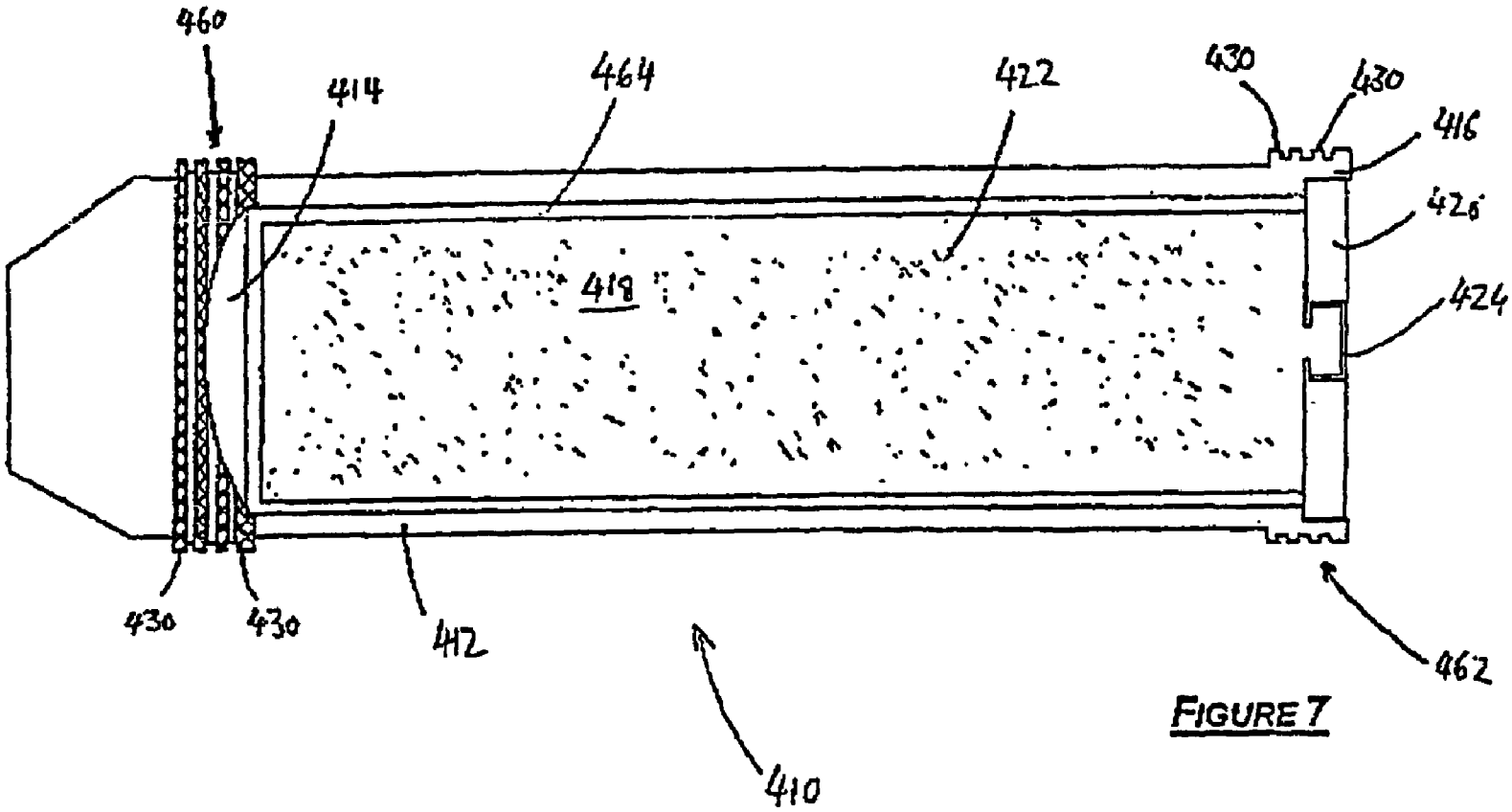
FIG. 7 is a partial section view of a fourth embodiment of the projectile.

FIG. 6 shows an end view of the base seal 26 and primer 24 which is used in the embodiments described above. FIG. 7 shows a projectile 410 according to a fourth embodiment having the same basic form as earlier embodiments and comprising a cylindrical body 412, opposite first and second ends 414, 416, a cavity 418 holding a volume of propellant 422, an integrally formed nose 420, and a base seal 426 that seals the cavity 418 and supports a primer 424.

The projectile 410 differs from earlier embodiments by the provision of eight seals 430 which extend about an outer circumferential surface 432 of the body 412 and protrude radially to form a substantial gas seal against an inner circumferential surface of the bore or barrel of the firearm from which the projectile 410 is fired. The seals 430 are arranged as two sets 460,462 each of four seals 430. One set 462 is adjacent the second end 416 while the second set 460 is formed toward the first end 414 but inboard of the nose 420. In this embodiment, the seals 430 are formed integrally with the body 412.

When compared with the seals 30 of the projectile 10 shown in FIG. 1, the seals 430 of the projectile 410 are particularly thin. Consequently, each seal 430 is more readily deformed on contact with the rifling within the barrel of a weapon. Thus, an effective gas seal is achieved with minimal loss of bullet energy.

The projectile 410 further differs from earlier embodiments by provision of a sleeve 464 within the cavity 418. The outer diameter of the sleeve 464 is equal to the inner diameter of the cavity 418. The propellant 422 is contained within the sleeve 464.

It may be desirable to form the body 412 from a material which is not significantly abrasive on the barrel of a weapon. Thus, the body 412 should be made of material which is softer than the material of the barrel. However, to withstand the high pressures generated during deflagration of the propellant 422, the wall thickness of the body 412 must increase as the hardness of the body 412 material decreases. In this embodiment, the sleeve 464 is made of a material which undergoes minimal expansion by the pressure generated by deflagration (when compared with that of the sleeve 464). Thus, by the inclusion of the sleeve 464, the wall thickness of the body 412 can be reduced which allows a larger amount of propellant 422 to be contained within the cavity 418 without the body 412 expanding unduly during firing.

Figure 8:
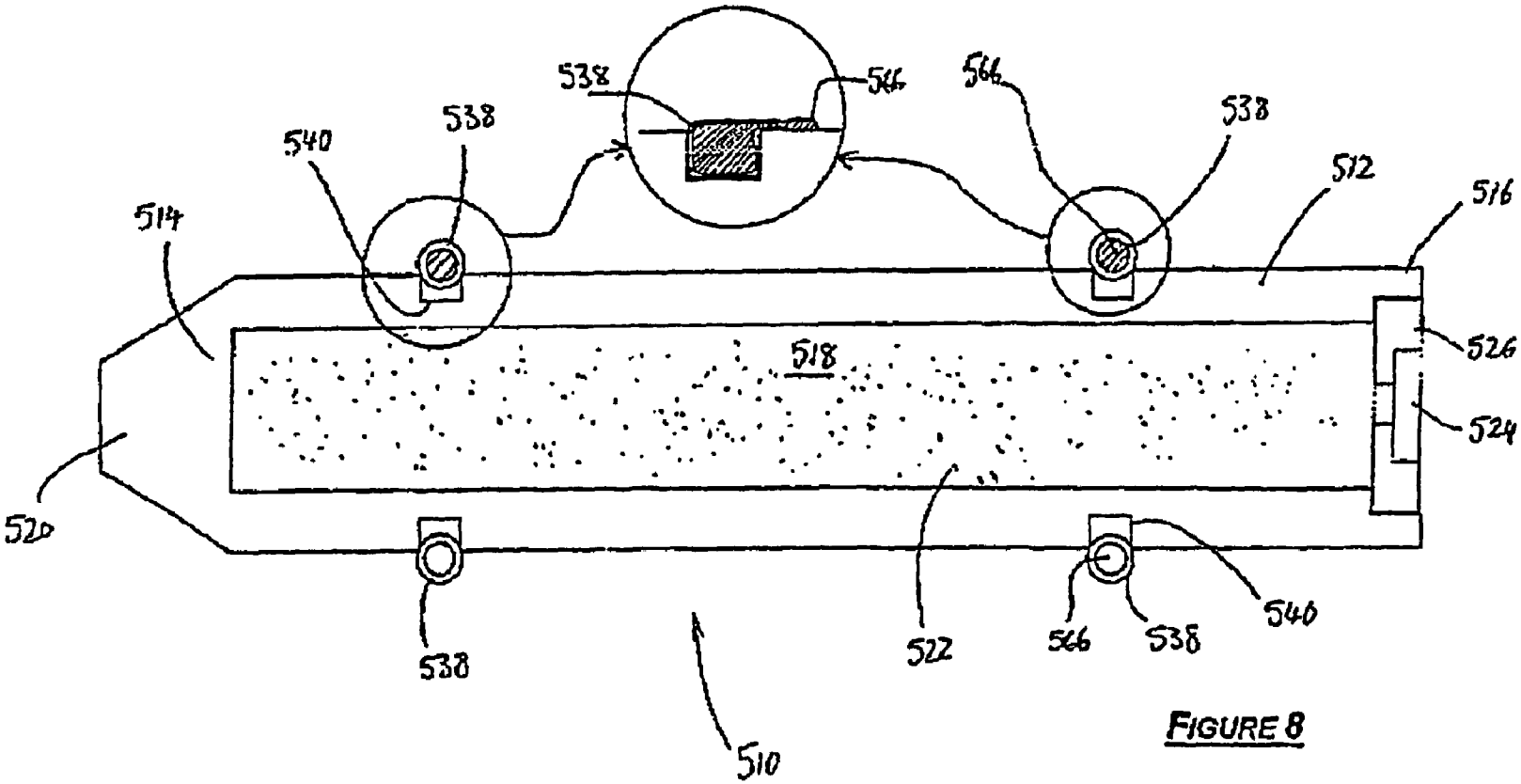
FIG. 8 is a section view of a fifth embodiment of the projectile.

FIG. 8 depicts a projectile 510 according to a fifth embodiment which is similar to the projectile 210 shown in FIG. 2 and includes the basic features of a body 512, opposite ends 514, 516, an integral nose 520 at end 514, a base seal 526 supporting a primer 524 at end 516, and an internal cavity 518 holding a volume of propellant 522. The projectile further comprises grooves 540 seating seals 530 in the form of individual sealing rings 538.

However in contrast to the projectile 210, in projectile 510, each ring 538 is hollow and contains a quantity of lubricant material 566. As the projectile 510 is fired through the barrel of a weapon, the rings 538 are deformed by contacting the rifling within the barrel. Lubricant 566 is then discharged from the respective ring 538. The lubricant 566 reduces friction between the projectile 510 and the barrel and can extend the life of the barrel.

The insert in FIG. 8 shows a ring 538 as the projectile 510 during firing. As shown in the insert, the lubricant 566 is drawn along the outer circumferential surface of the body 512.

It will be appreciated that alternate forms of lubricant could be used on each ring 538 while still achieving the above described lubricating function. For example, a lubricant material could be applied as a coating to the external surface of the ring 538. Alternatively, the ring 538 could be made of a lubricating material, such as TEFLON. It will also be appreciated that the terms "lubricant" and "lubricating", as used throughout this specification, are intended to define materials which reduce the friction between a projectile and a barrel of a weapon.

Figure 9:
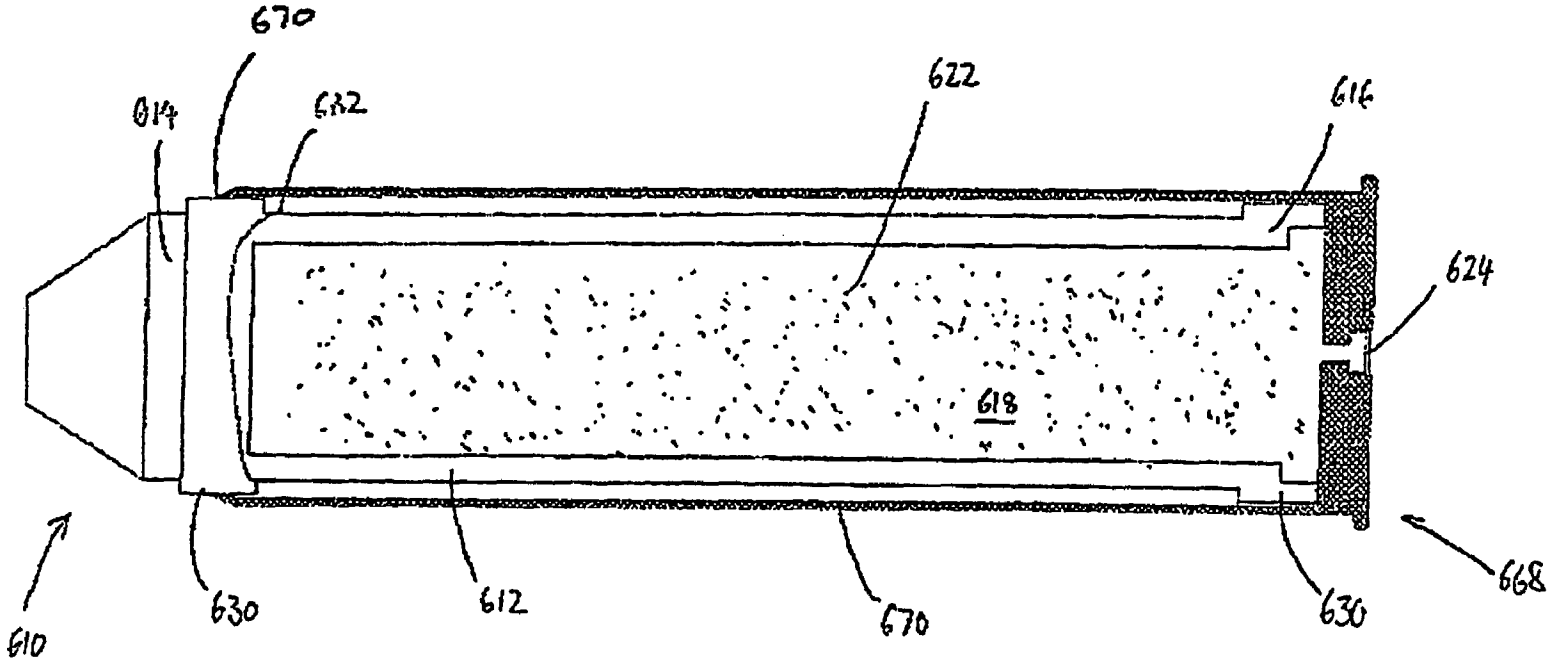
FIG. 9 is a partial section view of a sixth embodiment of the projectile.

FIG. 9 shows a projectile 610 according to a sixth embodiment comprising a cylindrical body 612, opposite ends 614 and 616, and a cavity 618 defined within the body 612 between the ends 614 and 616 holding a volume of propellant 622.

The projectile 610 has two integrally formed seals 630. The seals 630 extend about an outer circumferential surface 632 of the body 612 and protrude radially to form a substantial gas seal against an inner circumferential surface of the bore or barrel of the firearm from which the projectile 610 is fired. One seal 630 is adjacent the second end 616 while the second seal 630 is formed toward the first end 614 but inboard of the nose 620.

A significant difference between projectile 610 and the earlier embodiments is the provision of a case 668, or "cartridge" that initially houses the projectile 610. The case 668 comprises a tube 670 which is closed or sealed at one end by a base 626 provided in the case 668. The base 626 also retains the propellant 622 within the projectile 610 until the projectile 610 is to be fired through a barrel of a weapon. At the other axially opposed end of the tube 670 the case is open such that a portion of the projectile 610 protrudes beyond the open end of the tube 670. To retain the projectile 610 within the case 668 prior to firing, the open end of the tube 670 is lightly crimped against the projectile 610. A primer 624 is centrally supported in the base 626.

The case 668, containing the projectile 610, is inserted into the breech of a weapon. A firing pin of a weapon strikes the primer 624 causing it to ignite and eject a flame (not shown) through a flash hole 628 formed in the base 626. This causes the propellant 622 to deflagrate, producing large volumes of gas. The continued deflagration of the propellant 622 increases the pressure of the gas within the body 612 until the gas pressure reaches a level where the crimp on the case 668 can no longer hold the projectile 610 within the case 668. The gas pressure then acts between the projectile 610 and the internal surface of the tube 670 including the base 626, propelling the projectile 610 along the bore and subsequently into the surrounding atmosphere.

The case 668 essentially acts as an adaptor to enable projectiles in accordance with embodiments of the present invention to be used in firearms having different breech configurations. That is, the case 668 is made to suit a particular breech.

Figure 10:
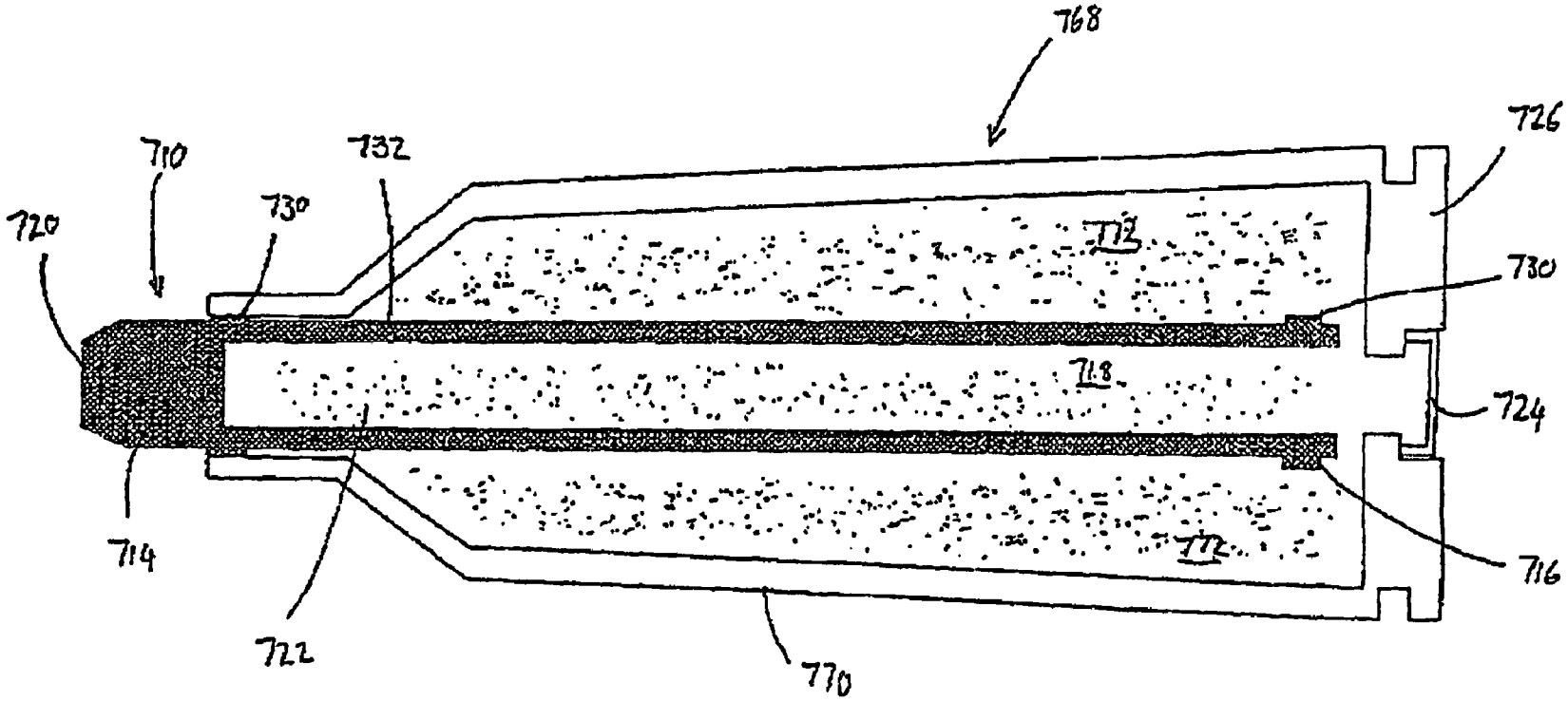
FIG. 10 is a section view of a eighth embodiment of the projectile.

FIG. 10 shows a cased projectile 710 according to a seventh embodiment. This embodiment is similar to that shown in FIG. 9 and comprises a cylindrical body 712 having a first end 714 and opposite second end 716, a cavity 718 defined within the body 712 between the ends 714 and 716 and holding a volume of propellant 722, an integral nose 720 fixed to the body 712 and closing end 714, and seals 730 extending about an outer circumferential surface 732 of the body 712 and protruding radially to form a substantial gas seal against an inner circumferential surface of the bore or barrel of the firearm from which the projectile 710 is fired.

The projectile 710 is initially also provided within a case 768, or "cartridge".

The case 768 however has a different shape and configuration to the case 668. In particular the case 768 is tapered such that there is a second cavity 772 between the tube 770 and the outer circumferential surface of the body 712. The second cavity 772 can be filled with additional propellant. The additional propellant provided within the second cavity 772 can have different deflagration characteristics when compared with the propellant 722 contained within the cavity 718.

For example, the propellant 722 may be slower burning when compared with that contained within the second cavity 772.

Figure 12:
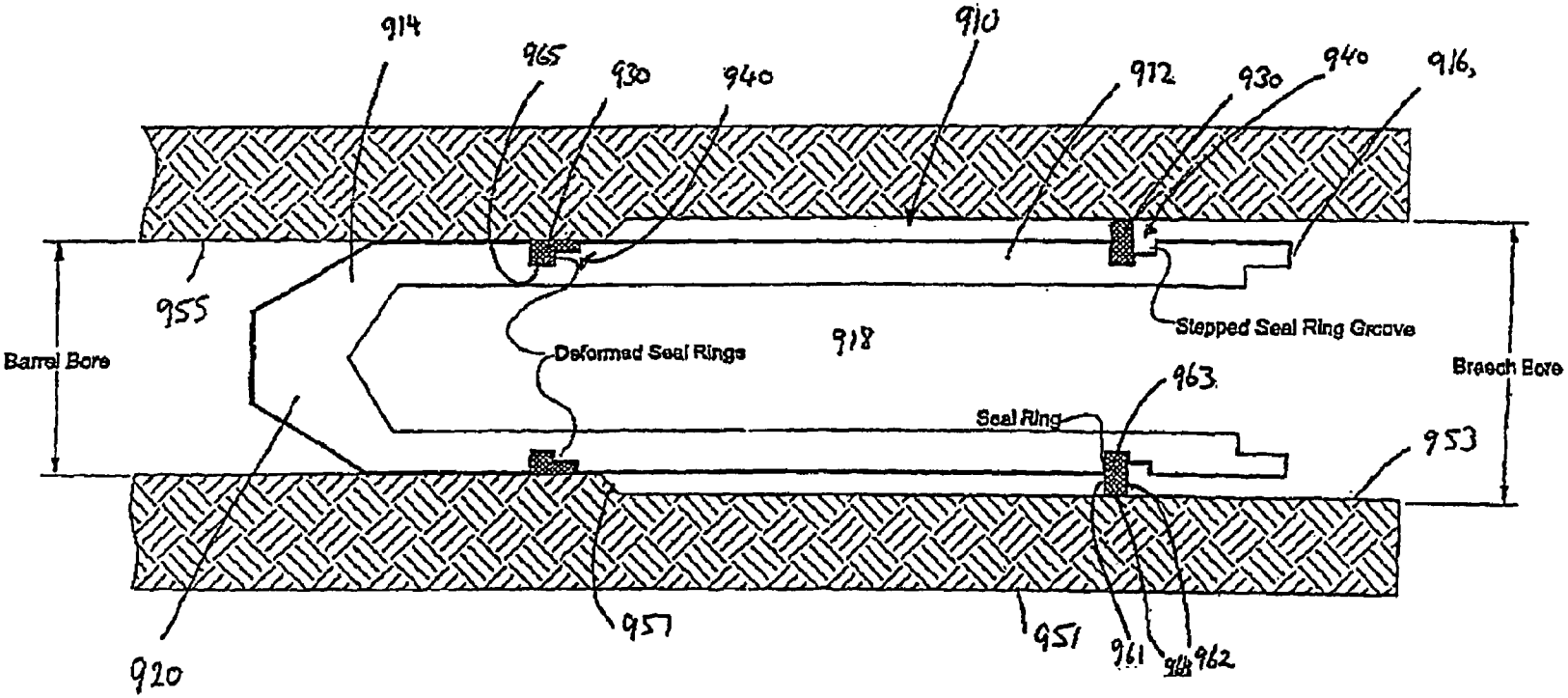
FIG. 12 is a section view of a ninth embodiment of the projectile.

FIG. 12 depicts a further embodiment of the projectile 910 which is of the same general form as the projectiles depicted in the earlier embodiments and comprises a substantially cylindrical body 912 having a first end 914 and opposite second end 916, an integrally formed nose 920 closing the first end 914, with a cavity 918 between the ends 914 and 916 for holding a volume of propellant (not shown). The projectile 910 is also closed by a base seal (not shown) supporting a primer in a form similar to that described in relation to the embodiment shown in FIGS. 1 and 2. The projectile 910 further comprises two sealing rings 930 each of which are seated in respective grooves 940 formed about the outer circumference of the body 912. The projectile 910 is shown in a barrel 951 of a firearm, the barrel 951 having a breech bore 953 and a downstream barrel bore 955. The breech bore 953 is of constant diameter and larger than the diameter of the barrel bore 955 which is also of constant diameter. However a tapered transition zone 957 is provided between the breech bore 953 and barrel bore 955. The transition zone 957 has an inner diameter which progressively decreases from the breech bore 953 to the barrel bore 955.

The projectile 910 differs from earlier embodiments having separate sealing rings such as the projectile 210 shown in FIG. 2, by forming the seals 910 as annular rings with opposite planar axial surfaces 961 and 962 and constant diameter inner and outer radial faces 963 and 964. Further, the grooves 940 within which the sealing rings 930 sit, are formed with a stepped configuration having a forward or deeper portion 965, and a contiguous downstream second shallower portion 966. The width of the first portion 965 is equal to the width of the sealing rings 930, while the depth of the second portion 966 is also equal to the width of the sealing rings 930. The width of the second portion 966 (also known as a "stepped section") of each groove is marginally more than the difference between the outside diameter of the body 921 of the projectile 910 and the outside diameter of the rings 930.

The rings 930 are sized to precisely the inner diameter of the breech bore 953. When the projectile 910 is fired, the sealing rings 930 act to prevent bypass of expanding high pressure gases of the burning propellant which urges the projectile 910 into the barrel bore 955, at which time the sealing rings 930 are deformed to seat in the groove 930 and in particular the portion 966 of the groove 930.

In the prior art, depending upon the tolerance between the projectile outer diameter and barrel inner diameter, such compression of a sealing ring could cause a projectile to jam in the barrel or at the very least cause high frictional drag. If the sealing ring thickness were thin enough to minimize this frictional drag, then there is a real possibility that they would rupture or separate from the projectile when subjected to very high gas pressures within the firearm breech which may approach twenty tonnes per square inch. With the projectile 910, the rings 930 are formed of a thickness sufficient to withstand the initial high pressure propulsion forces within the breech generated during firing, but sufficiently malleable so as to deform into the stepped section of the sealing ring groove when the projectile 910 is fired. This action would still maintain effective sealing within the barrel and tend to reduce the resultant friction generated if the sealing ring deformation could not otherwise be accommodated.

Initial testing on embodiments of the present invention has indicated the following benefits over a conventional round:

- less propellant for greater bullet energy;
- reduced apparent recoil from a higher energy bullet;
- lower sound pressure levels;
- heavier projectile for a given calibre;
- higher projectile velocity, and thus a flatter projectile trajectory can be achieved.

In addition it is also believed that embodiments of the present invention may enjoy one or more of the following advantages over conventional rounds:

- lower manufacturing cost;
- fewer component parts;
- reduced total ammunition weight for a given number of rounds;
- simpler breech mechanism in a purpose-designed breech for the projectile due to the elimination of the extractor and ejector;
- higher cyclic rate of fire in a purpose designed automatic weapon due to shorter cycle breech mechanism.

During preliminary testing, embodiments having an outer diameter of the cylindrical body of 99% of the inner diameter of the barrel were successfully fired from a weapon. It is envisaged that the outer diameter of the cylindrical body could be up to 99% of the inner diameter of the barrel. Whilst the seals should have an outer diameter greater than that of the cylindrical body, the outer diameter of the seals should be within the range of 95% to 105% of the inner diameter of the barrel. For optimal performance, the outer diameter of the cylindrical body should be within the range of 97% to 99% of the inner diameter of the barrel, and the outer diameter of the seals should be within the range of 99% to 100% of the inner diameter.

Figure 11:
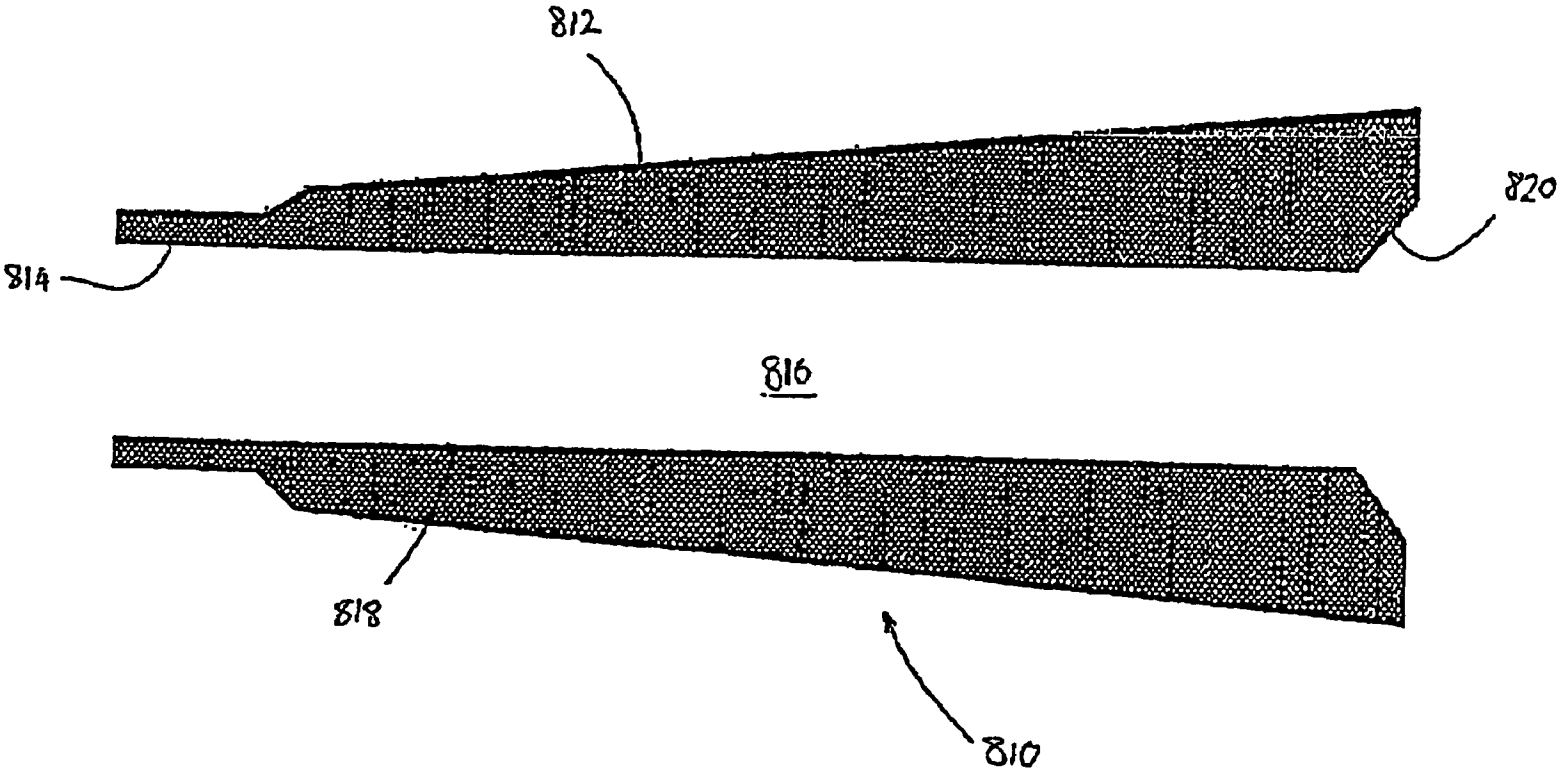
FIG. 11 is a section view of an embodiment of an breech sleeve.

In some standard cased projectiles, the case is tapered such that the end adjacent the firing pin has a larger diameter than the end from which the projectile protrudes. A weapon having a tapered breech is used to fire such projectiles contained within a tapered case, or cartridge. In order for projectiles having a cylindrical body (as shown in FIGS. 1 to 3, 7 and 8) to be fired from a weapon having a tapered breech, a breech sleeve 810 is provided, as shown in FIG. 11. The outer surface 812 of the breech sleeve 810 is shaped to fit the tapered profile of the tapered breech of the weapon (not shown). The breech sleeve 810 has a throughway 816 through which a projectile such as, for example, the projectile 10 shown in FIG. 1 can pass. The throughway 816 is defined by the internal surface 814 of the breech sleeve 810. The internal surface 814 defines a parallel tube 818 and a funnel portion 820 at one end of the breech sleeve 810 to guide a projectile into the throughway 816 during loading of the projectile into the breech.

It will be appreciated that the shape of the outer surface 812 of the breech sleeve 810 can be modified from that shown to suit the profile of the breech of a chosen weapon. For example, the breech of a weapon may have two parallel tubular portions of different diameters. Alternatively, the breech of the weapon may be a parallel tubular shape with a diameter slightly larger than the inner diameter of the barrel of the weapon.

The breech sleeve 810 can be removed from the breech of the weapon and/or refitted if required. This allows the weapon to be used with either conventional ammunition or a projectile as shown in FIGS. 1 to 3 or 7 to 10.

Now that embodiments of the present invention have been described in detail it will be apparent to those skilled in the relevant arts that numerous modifications and variations may be made without departing from the basic inventive concepts. For example, the nose 20 may be made of numerous different configurations including flat, rounded, pointed or provided with hardened and/or armour piercing tips. Also, the propellant 22 may be liquid, powder, granular, solid, gaseous or any combination thereof. In particular the propellant 22 may comprise a combination of say two or more granular propellants of different deflagration characteristics (i.e. fast burn and slow burn) generating additional propulsive force after the projectile exits the barrel. Also any suitable detonator primer 24 may be used including a percussion primer and an electric or electronic primer.

The body 12 can be made from many types of different materials using many different types of manufacturing processes. For example, the body 12 may be made from plastics material machined from solid stock, or injection moulded. Alternately the body 12 may be made from a metal or metal alloy which is machined from solid stock, cast, stamped, punched or pressed using any number of standard engineering manufacturing practices. In addition the body 12 may be made from rubber, polymers or even paper/cellulosic material.

Preliminary testing has indicated good results with a body made of steel and seals made of copper. Preliminary testing has also indicated good results with a body made of brass, the body having integrally formed seals which are also made of brass.

Also, in FIG. 3 the mass 44 is shown as having a single continuous lip 50 seated in a groove 52. However the lip may be replaced with a plurality of members such as spaced apart lugs or protrusions which are received in corresponding seats formed about the body 12.

It will also be appreciated that embodiments of the projectile in accordance with the present embodiment can be fired from conventional parallel-chambered breech firearms without any modification required.

All such modifications and variations together with others that would be obvious to a person of ordinary skill in the art are deemed to be within the scope of the present invention the nature of which is to be determined from the above description and the appended claims.

The claims defining the invention are as follows:

1. A caseless projectile for firing out of a barrel of a small arms weapon, the barrel being made of a barrel material and having an inner diameter, the projectile comprising: a substantially cylindrical body with first and second axially opposite ends and a cavity extending between the first end and the second end for holding a quantity of propellant, the first end being closed by a nose integral to the body, the cylindrical body having a first outer diameter which is less than the inner diameter of the barrel, the cylindrical body being made of a first material;

at least two seals extending about an outer circumferential surface of the body, a primer for igniting the propellant, the primer being supported by the cylindrical body and located inboard of the second end of the cylindrical body, the primer being centrally disposed about a longitudinal axis of the cylindrical body;

each seal protruding radially from the body to form a substantial seal against an inner circumferential surface of the barrel and having a second outer diameter greater than the first outer diameter and equal to or greater than the inner diameter of the barrel, the at least two seals being made of a second material; each seal being in the form of an individual ring, the seals being spaced apart along the cylindrical body with a portion of the cylindrical body between the seals being exposed; and wherein the second material is softer than the barrel material, and the first material is harder than the second material.

2. A projectile according to claim 1, wherein the projectile comprises a first seal positioned near the first end of the body and a second seal positioned near the second end of the body.

3. A projectile according to claim 1, wherein the cylindrical body is provided with a groove for each of the at least one seal, each groove extending circumferentially about an outer circumferential surface of the body.

4. A projectile according to claim 3, wherein each groove comprises a first portion and a second portion, the first portion being forward of the second portion in a direction of firing of the projectile, wherein the first portion is of a greater depth than the second portion.

5. A projectile according to claim 4, wherein the first portion has a width equal to a width of the seal.

6. A projectile according to claim 4, wherein the second portion has a depth equal to the width of the seal.

7. A projectile according to claim 4, wherein the second portion has a width greater than a difference between the second outer diameter and the first outer diameter.

8. A projectile according to claim 1, wherein the first material comprises steel.

9. A projectile according to claim 1, wherein the first material comprises brass.

10. A projectile according to claim 1, wherein the second material comprises copper.

11. A projectile according to claim 1, wherein at least one of the seals is formed separately from the body.

12. A projectile according to claim 11, wherein each seal is in the form of a ring.

13. A projectile according to claim 1, wherein there is provided a first seal adjacent the first end and a second seal adjacent the second end, the second seal having an outer diameter greater than the inner diameter of the barrel such that the second end of the projectile can be supported in a breech that opens into the barrel of the weapon.

14. A projectile according to claim 1, further comprising:

a base seal closing the second end of the cylindrical body, such that the primer is supported by the base seal, wherein the base seal opens after ignition of the primer to allow gases produced during deflagration of the propellant to escape from the second end of the cylindrical body.

15. A projectile according to claim 14, wherein the base seal is formed so that the base seal is ruptured by the gases produced during deflagration of the propellant, thereby opening the base seal.

16. A projectile according to claim 14, wherein the base seal is formed so that it is consumed during deflagration of the propellant, thereby opening the base seal.

17. A projectile according to claim 14, wherein a flash hole is provided in the base seal such that a flame generated by ignition of the primer can propagate through the flash hole to the propellant.

18. The projectile according to claim 1, wherein each ring has an axial length and a constant outer diameter for the axial length.

19. The projectile according to claim 18, wherein an outer diameter of the cylindrical body immediately adjacent opposite sides of at least the first seal is constant.

* * * * *